US006322007B1

(12) United States Patent
Potz et al.

(10) Patent No.: US 6,322,007 B1
(45) Date of Patent: Nov. 27, 2001

(54) FUEL INJECTION VALVE FOR INTERNAL COMBUSTION ENGINES

(75) Inventors: Detlev Potz, Stuttgart; Michael Mennicken, Heimsheim; Ralf Wirth, Leonberg; Ralf Maier, Schwabisch-Gmund; Barbara Heine, Stuttgart; Stefan Haug, Waldenbuch, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/529,227

(22) PCT Filed: Jun. 16, 1999

(86) PCT No.: PCT/DE99/01752

§ 371 Date: Apr. 10, 2000

§ 102(e) Date: Apr. 10, 2000

(87) PCT Pub. No.: WO00/14400

PCT Pub. Date: Mar. 16, 2000

(30) Foreign Application Priority Data

Sep. 9, 1998 (DE) ..... 198 41 192

(51) Int. Cl.[7] ..... F02M 61/20
(52) U.S. Cl. ..... 239/533.9; 239/533.3
(58) Field of Search ..... 239/533.9, 533.2, 239/533.3, 533.12

(56) References Cited

U.S. PATENT DOCUMENTS 3,836,080 * 9/1974 Butterfield .
4,106,702 * 8/1978 Gardner et al. ..... 239/533.9 X
5,163,621 * 11/1992 Kato et al. ..... 239/533.9 X
5,242,118 * 9/1993 Schmidt et al. ..... 239/533.9 X
5,725,157 * 3/1998 DeLuca ..... 239/533.9 X
5,890,660 * 4/1999 Stevens ..... 239/533.9 X

FOREIGN PATENT DOCUMENTS

767886 * 5/1954 (DE) .
2358220 * 5/1975 (DE) .
19634933 * 3/1998 (DE) .
404407-A1 * 12/1990 (EP) ..... 239/533.9
2223270 * 4/1990 (GB) .
WO-96/19661 * 6/1996 (WO) .

* cited by examiner

*Primary Examiner*—Lesley D. Morris
(74) *Attorney, Agent, or Firm*—Ronald E. Greigg

(57) ABSTRACT

A fuel injection valve for internal combustion engines, having a valve member guided axially displaceably, counter to a closing force, in a blind bore of a valve body. The valve member on an end toward the combustion chamber has a conical valve sealing face, with which the valve sealing face cooperates with a conical valve seat face on the inward-projecting closed end of the blind bore. A blind bore region, adjoins the conical valve seat face downstream, from which region injection openings lead into the combustion chamber of the engine. The blind bore wall region that receives the injection openings is embodied conically, and the injection openings have a certain minimum spacing from an upper and a lower end of this conical blind bore wall region.

5 Claims, 1 Drawing Sheet

FUEL INJECTION VALVE FOR INTERNAL COMBUSTION ENGINES

PRIOR ART

The invention is based on a fuel injection valve for internal combustion engines. In one such fuel injection valve, known from German published, nonexamined patent application DE 42 02 752, a valve member is guided in a blind bore of a valve body, axially displaceably counter to a closing force. The valve member, lower end toward the combustion chamber, has a conical valve sealing face, with which it cooperates with a conical valve seat face on the inward-projecting closed end of the blind bore. Between the valve seat face and the valve sealing face, an opening cross section is formed at which a flow of fuel from a high-pressure fuel chamber into the closed end of the blind bore can be controlled. The conical valve seat face of the known valve is downstream by a further blind bore wall region, from which a plurality of injection openings lead away into the combustion chamber of the engine to be supplied.

The known fuel injection valve has the disadvantage that the wall region of the blind bore adjoining the valve seat face is embodied cylindrically and furthermore in radius form, so that even slight production variations in the axial disposition of the injection openings result in different inlet angles at the injection openings, which alter the inflow behavior, the flow inside the injection opening, and thus the injection stream characteristic at the outlet openings. However, since the stream characteristic at all the injection openings has very great significance in terms of optimal stream preparation and fuel combustion in the combustion chamber of the engine, the known fuel injection valves no longer meet the high demands made of modern fuel injection valves in terms of emissions-optimized stream preparation and combustion inside the engine.

ADVANTAGES OF THE INVENTION

The fuel injection valve according to the invention for internal combustion engines, has an advantage over the known valve that with respect to their placement, the injection openings have a high tolerance for production variation, so that particularly deviations in position in the axial direction of the injection valve initially have no influence whatever on the flow conditions at the injection openings. This relative independence of the axial positional tolerance of the injection openings is attained according to the invention by means of the conical embodiment of the region of the blind bore of the fuel injection valve that receives the injection openings. At their inlet openings, the injection openings have a predetermined minimum spacing from the upper and lower ends of the conical blind bore wall region; the spacing between the upper end of an inlet opening of the injection opening and an upper, upstream boundary edge of the conical blind bore wall region is the size of at least half the diameter of the injection opening. Advantageously, the spacing between the lower end of an inlet opening of the injection opening and a lower, downstream boundary edge of the conical blind bore wall region is the size of at least one-quarter of the diameter of the injection opening. This assures that even if there is a slight offset among the individual injection openings in the axial direction of the fuel injection valve from one another, the inlet angles at all the injection openings will always constantly have the same value, so that the injection streams can be embodied uniformly. It is advantageous that the valve seat face and the conical blind bore wall region following the valve seat face downstream have different cone angles. The conical blind bore wall region and the valve seat face can adjoin one another directly, but it is also possible as an alternative, as shown in the exemplary embodiment, to provided a cylindrical wall segment region between these two faces. The transition from this wall segment face to the conical blind bore wall region that receives the injection openings is advantageously rounded off in a streamlined way with a radius. It is possible to dispose all the injection openings in the same row of injection ports in a single conical face, but it is also possible to embody the conical blind bore wall face with a plurality of successive conical faces; one row of injection ports can then be disposed in each conical face. Once again, certain minimum spacings of the inlet openings of the injection openings from the ends of the conical faces should be provided.

A further advantage of the fuel injection valve of the invention is the disposition of the injection opening, embodied as an injection bore, at an acute angle $\beta$ from the wall surface of the conical blind bore wall upstream of the injection opening. This angle of inclination $\beta$ between the longitudinal axis of the injection bore and the conical blind bore wall region located upstream of the injection bore should also be embodied as $<90°$. This angular range makes a sharp deflection inlet angle in the fuel flow possible at the top of the inlet opening of the injection bore; the fuel flow is thus made turbulent and generates cavitation, so that within the injection bore an injection stream forms whose flow profile is embodied such that at the outlet of the injection bore it is atomized as quickly as possible, which results in good stream preparation in the engine combustion chamber and optimal ensuing fuel combustion.

On the assumption that the sum between the cone angle $\Psi$, formed between the longitudinal axis of the fuel injection valve and the longitudinal axis of the injection bore, and the aforementioned inlet angle $\beta$ and the angle alpha enclosed between the longitudinal axis of the injection valve and the conical blind bore wall are 180°, it is now possible in designing the fuel injection valve, at a predetermined inlet angle $\beta$ and a projected inlet face at the inlet opening of the injection bore, and at a cone angle T predetermined by the desired stream position, to calculate the cone angle $\alpha$ of the conical blind bore wall face at the injection openings in such a way that an optimal velocity profile of the injection stream, or an optimal velocity profile of the injection stream, or an optimal stream characteristic of the injection stream, at the outlet of the injection opening can be attained. Thus compared with the known fuel injection valves at predetermined cone angles $\Psi$, an inlet angle $\beta<90°$ is established by way of the constructive design of the cone angle $\alpha$ of the conical blind bore wall face. In this way, very stable inflow conditions for all the injection openings can be established, which also meet the high demands made of new modern fuel injection systems, such as pump-line nozzles, unit fuel injectors, and common rail systems. In addition, compared with rounding of the inlet edges of the injection port, high production tolerances are obtained, so that very stable fuel injection stream geometries at all the injection openings can be attained here.

Further advantages and advantageous features of the subject of the invention can be learned from the specification, drawing and claims.

BRIEF DESCRIPTION OF THE DRAWING

One exemplary embodiment of the fuel injection valve of the invention for internal combustion engines is shown in the drawing and described in further detail in the ensuing description.

DESCRIPTION OF THE EXEMPLARY EMBODIMENT

Figure 1:
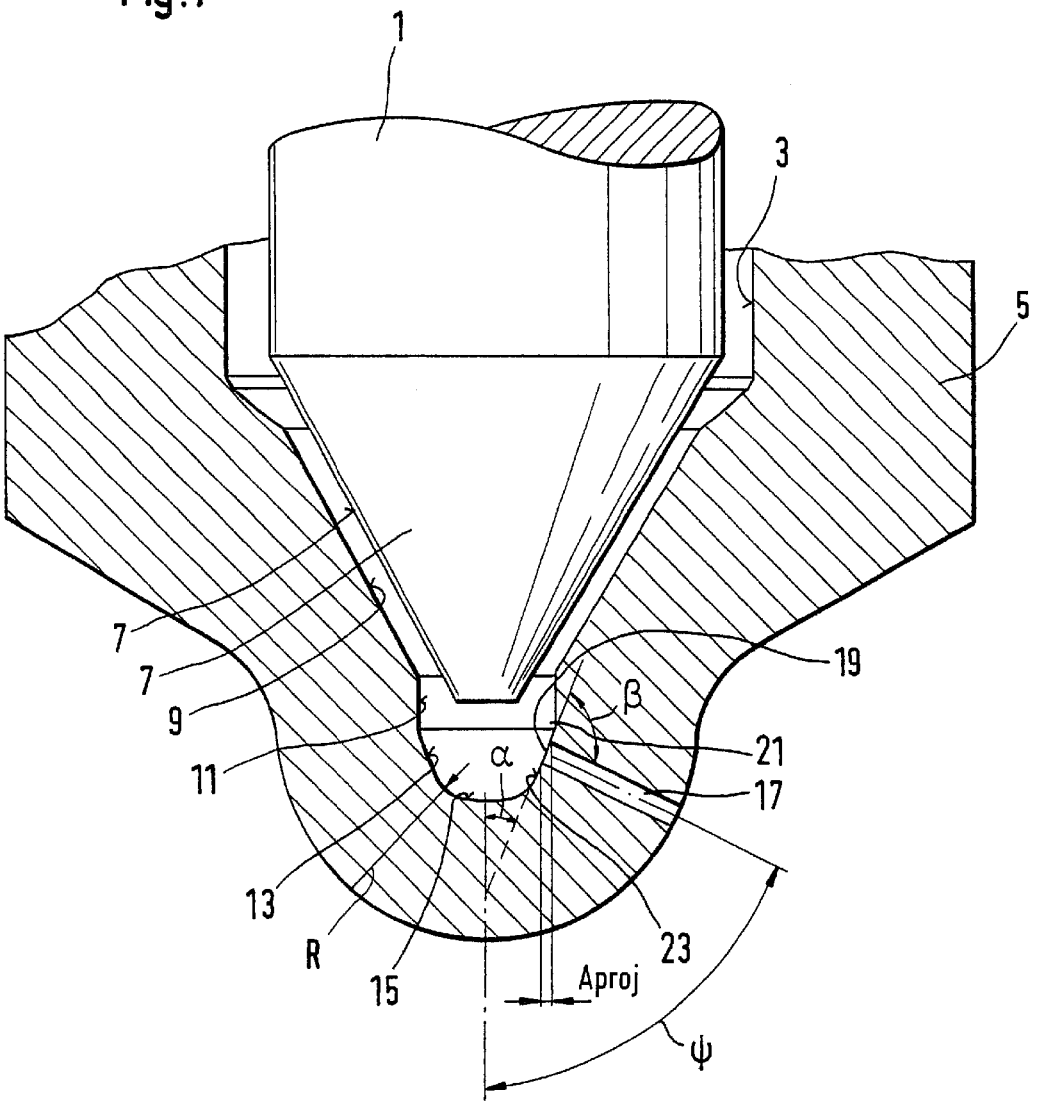
FIG. 1 is a longitudinal section through the injection end of an otherwise known fuel injection valve, having the design according to the invention of the closed end of the blind bore.

The exemplary embodiment of the fuel injection valve according to the invention for internal combustion engines, which is shown in FIG. 1 in terms only of its part toward the combustion chamber that is essential to the invention, has a piston-like valve member 1, which is guided axially displaceably in a blind bore 3 of a valve body 5. On its lower end toward the combustion chamber, the valve member 1 has a conical valve sealing face 7, with which the sealing face cooperates with a conical valve seat face 9 on the inward-projecting closed end of the blind bore 3. This conical valve seat face 9 is adjoined downstream, in the direction of the closed end of the blind bore 3, by a cylindrical wall segment 11, which is adjoined of the remote from the valve seat face 9 and downstream, cylindrical wall segment 11 by a further conically embodied blind bore wall region 13, which discharges directly at the bottom 15 of the blind bore 3. The cross-sectional transitions between the conical blind bore wall region 13 and the cylindrical wall segment 11 and the bore bottom 15 are rounded off via a radius R. In addition, injection openings 17 lead away from the conical blind bore wall face 13 and discharge at the circumference of the valve body 5 into the combustion chamber of the engine to be supplied. The inlet openings 19 of the injection openings 17, when the fuel injection valve is closed or in other words when the valve sealing face 7 of the valve member 1 rests on the valve seat face 9 in a closed position, not shown, in which a closing spring, also not shown, keeps the valve member 1 in contact with the valve seat 9, are not sealingly covered by the valve sealing face 7 of the valve member 1, and thus the fuel injection valve of the invention is embodied as a so-called blind bore nozzle. The inlet openings 19 have a predetermined minimum spacing from the upstream-pointing upper end of the conical blind bore wall region 13 and from its lower, downstream-pointing end. The spacing between the upper, upstream-pointing boundary edge of the injection opening 19 and an upper, upstream boundary edge 21 of the conical blind bore wall region 13 should have the size of at least half the diameter of the injection opening 17. The spacing between the lower, downstream-pointing edge of the inlet opening 19 of the injection opening 17 and a lower, downstream boundary edge 23 of the conical blind bore wall region 13 should amount to at least one-fourth the diameter of the injection opening 17. In addition, the cone angles of the valve seat face 9 and the conical blind bore wall face 13 should have different cone angles.

For the sake of the sharpest possible stream deflection at the entrance to the inlet opening 19 of the injection opening 17, an inlet angle $\beta$ at the top of the inlet opening 19 of the injection opening 17 between its bore axis and the conical blind bore wall face 13 should be embodied as less than 900. In this way, when the fuel flows over from the blind bore 3 into the injection opening 17 at the top of the inlet opening 19, reverse eddies and also cavitation are generated, which make the highest possible stream turbulence, and thus at the outlet of the injection opening 17 the atomization of the injection stream as close as possible to the nozzle, possible. From the known relationship that the sum of the cone angle $\Psi$, which is formed between the longitudinal axis of the fuel injection valve and the axis of the injection opening 17, and a cone angle $\alpha$, which is enclosed between the longitudinal axis of the fuel injection valve and the conical blind bore wall 13, and the inlet angle $\beta$ are 180°, the following nozzle construction rule can be derived. An inlet angle $\beta$ that is optimized in terms of streamlining is predetermined and then, as a function of a predetermined cone angle $\Psi$, it determines the necessary angle for the cone angle $\alpha$. The value of the cone angle $\Psi$ is likewise predetermined by the desired stream position of the injected fuel in the engine combustion chamber. In this way, by way of a precisely defined blind bore geometry, an optimal stream embodiment and characteristic in the combustion chamber of the engine can be attained.

With the fuel injection valve of the invention, it is thus possible, by way of a precisely defined blind bore geometry, to make the arrangement of individual injection openings in the valve body 5 highly insensitive to tolerances; even if there are slight deviations in position, a uniform stream pattern at the outlet openings of all the injection openings is also assured.

The foregoing relates to a preferred exemplary embodiments of the invention, it being understood that other variants and embodiments thereof are possible within the spirit and scope of the invention, the latter being defined by the appended claims.

What is claimed is:

1. A fuel injection valve for internal combustion engines, comprising a valve member (1) which is guided axially displaceably, counter to a closing force, in a blind bore (3) of a valve body (5), said valve member on an end toward the combustion chamber has a conical valve sealing face (7), with which the conical sealing face cooperates with a conical valve seat face (9) on an inward-projecting closed end of the blind bore (3), and having a blind bore region, adjoining the conical valve seat face (9) downstream, from the blind bore region injection openings (17) that lead into the combustion chamber of the engine, the blind bore wall region (13) that receives the injection openings (17) is embodied conically, and the injection openings (17) have a certain minimum spacing from an upper and a lower end (21, 23) of this conical blind bore wall region (13), a cylindrical wall segment (11) is provided between the conical valve seat face (9) and the conical blind bore wall region (13) that receives the injection openings (17), and the transitional surface between the cylindrical wall segment (11) and the conical blind bore wall region (13) is rounded off with a radius R.

2. The fuel injection valve of claim 1, in which the spacing between the upper end of an inlet opening (19) of the injection opening (17) and an upper, upstream boundary edge (21) of the conical blind bore wall region (13) are the size of at least half a diameter of the injection opening (17).

3. The fuel injection valve of claim 1, in which the spacing between the lower end of an inlet opening (19) of the injection opening (17) and a lower, downstream boundary edge (23) of the conical blind bore wall region (13) is a size of at least one-quarter of a diameter of the injection opening (17).

4. The fuel injection valve of claim 1, in which the conical valve seat face (9) and the conical blind bore wall region (13) following the conical valve seat downstream have different cone angles.

5. The fuel injection valve of claim 1, in which the injection openings (17) are embodied as injection bores, whose longitudinal axis has an inlet angle $\beta<90°$ relative to the wall face of the conical blind bore wall region 13 upstream of the injection opening 17.

* * * * *